United States Patent [19]

LaBrecque

[11] 4,255,895

[45] Mar. 17, 1981

[54] LIGHTING UNIT FOR FLIGHT TOY OR THE LIKE

[76] Inventor: John F. LaBrecque, 22542 Audrey St., Warren, Mich. 48091

[21] Appl. No.: 54,031

[22] Filed: Jul. 2, 1979

[51] Int. Cl.[3] ..... A63H 33/26

[52] U.S. Cl. ..... 46/228; 46/74 D

[58] Field of Search ..... 46/74 D, 228, 226; 362/109, 252, 806, 810, 104, 105, 106, 184; 273/424, 425

[56] References Cited

U.S. PATENT DOCUMENTS

| | | | |
|---|---|---|---|
| 2,774,860 | 12/1956 | Prebol et al. | 362/184 |
| 3,384,741 | 5/1968 | Bice | 362/184 X |
| 3,948,523 | 4/1976 | Michael | 46/228 X |
| 4,086,723 | 5/1978 | Strawick | 46/74 D |
| 4,134,229 | 1/1979 | Lehman | 46/228 |

*Primary Examiner*—Gene Mancene
*Assistant Examiner*—Mickey Yu
*Attorney, Agent, or Firm*—Fisher, Gerhardt, Crampton & Groh

[57] ABSTRACT

An improved double-ended lighting unit detachably mountable upon a disc shaped flight toy or other object. An elongate tubular metal housing adapted to receive two (or some other even number) flashlight batteries has an opening at each of its opposite ends threaded to threadably receive a flashlight bulb. A metal fastening member, such as a bolt, is passed diametrically through the tube at a location midway of length of the tube to serve the dual function of a mounting member to secure the assembly to another object and to also serve as an electrical connection between the tubular metal housing and one end of a battery located within the tube. The length of the tube is such that a bulb threadably supported in one end of the housing can be threadably adjusted into or out of electrical contact with a battery within the tube which is in electrical contact with the fastening member.

1 Claim, 3 Drawing Figures

LIGHTING UNIT FOR FLIGHT TOY OR THE LIKE

BACKGROUND OF THE INVENTION

In recent years, several patents have been granted for illuminated disc shaped flight toys or so-called "frisbies". Among these patents are those to Peterson, et al U.S. Pat. No. 3,720,018, Johnson, et al U.S. Pat. No. 3,786,246; Samuel U.S. Pat. No. 3,798,834 and Michael U.S. Pat. No. 3,948,523. As pointed out in these patents, an illuminating device in toys of this type enables them to be used in the evening under poor lighting conditions. While several forms of illuminating units are disclosed in the patents referred to above, all of them are designed as a permanent type of installation which in the usual case requires some structural modification of the toy. Because the lighting unit adds a substantial amount of weight to the toy, it detracts from its flight characteristics and the inability to detach the lighting unit from the toy restricts its usefulness.

The present invention is especially directed to a lighting unit of relatively simple and lightweight construction which may be readily mounted on or detached from the toy with a single nut and bolt connection through a centrally located hole in the toy.

SUMMARY OF THE INVENTION

The present invention includes an elongate hollow metal tube which may be of relatively thin wall thickness. The tube is dimensioned preferably to receive two size AAA size dry cells in ent-to-end relationship. The tube is transversely bored at its axial midpoint to loosely receive a metal bolt which passes diametrically through the tube to receive a nut to detachably mount the tube on the inner or concave side of the toy. In addition to functioning as a mounting member, the bolt also functions as an electric terminal to electrically connect one end of each of the two batteries received in the tube to the tube itself.

The opposite ends of the tube are formed with a threaded opening which will receive at each end of the tube a conventional threaded base flashlight bulb. The length of the tube is such that a bulb threadably received in one end of the tube can be threaded back and forth a sufficient distance to move the base of the bulb axially into or out of contact with one end of a battery whose opposite end is in electrical contact with the fastening bolt.

Other objects and features of the invention will become apparent by reference to the following specification and to the drawings.

IN THE DRAWINGS

Figure 1:
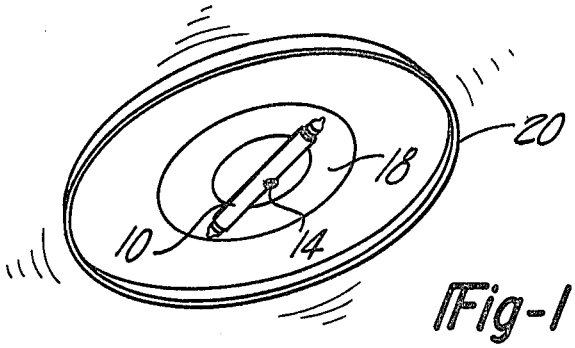
FIG. 1 is a prospective view of a flight toy carrying an illuminating unit of the present invention.

The illuminating unit of the present invention includes an elongate tubular metal housing 10 which is transversely bored at its axial midpoint as at 12 to receive a bolt 14 which passes diametrically through the tube. A nut threadably received on bolt 14 may be employed to detachably mount the tube 10 upon a support surface as by passing the bolt through a bore 18 in a flying disc toy 20 (FIG. 1).

Figure 2:
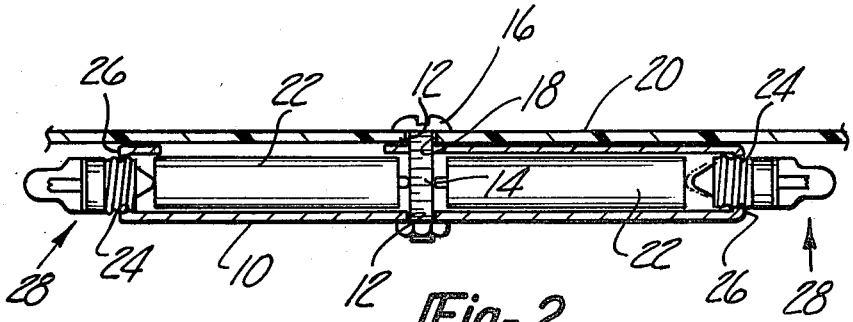
FIG. 2 is a detailed cross sectional view of an illuminating unit embodying the present invention.

The internal diameter of the tube 10 is such as to threadably receive flashlight batteries 22 within the tube. Openings 24 at opposite ends of the tube are formed in the tube end walls 26 to threadably receive the threaded bases of flashlight bulbs designated generally 28. As best seen in FIG. 2, when bulbs 28 are fully threaded into openings 24, the bulb base presses against one end of battery 22 to force the opposite end of the battery against bolt 14 to thus complete an electrical circuit from one end of the battery via bolt 14 to the tube 10 and through bulb 28 to the opposite end of battery 22.

The length of tube 10 is selected to be such that a bulb 28, while threadably supported in tube 10, may be threaded into contact with one end of a battery 22 whose opposite end is in electrical contact with bolt 14 or, alternatively as shown in full line at the right-hand end of FIG. 2, the bulb 28 may be threaded outwardly a distance such that electrical contact cannot be maintained by the battery with both bolt 14 and bulb 28.

Figure 3:
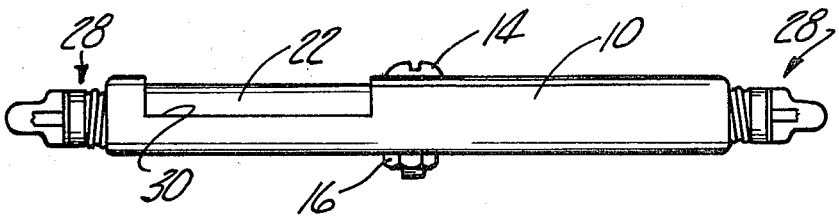
FIG. 3 is a side elevational view of the illuminating unit.

Batteries may be inserted into the interior of tube 10 through an opening 30 best seen in FIG. 3. The length of opening 30 is slightly less than that of a battery, and removal of a battery requires the removal of the bulb 28 at that end of the tube in which opening 30 is located. The internal diameter of the tube exceeds the battery diameter by an amount sufficient so that the battery can be tilted within the tube, when the bulb is removed, a sufficient amount to permit its withdrawal. Removal of the right-hand battery as viewed in FIG. 2 also requires the removal of bolt 14, the openings in end walls 26 having a diameter less than that of the battery diameter.

From the foregoing description, it is believed apparent that the illustrating unit described can be easily attached to or detached from the toy 20, and that the sole modification of the toy 20 required to accept the unit is the provision of a relatively small, centrally located bore 18 in the toy to receive bolt 14.

While one embodiment of the invention has been described in detail, it will be apparent to those skilled in the art that the disclosed embodiment may be modified. Therefore, the foregoing description is to be considered exemplary, rather than limiting, and the true scope of the invention is that defined in the following claims.

What is claimed is:

1. In a concave disc or saucer-shaped flight toy having illuminating means mounted thereon; the improvement wherein the flight toy has a single bolt receiving opening therethrough at the center of rotation of said toy, and said illuminating means comprises an elongate hollow metal tube, a pair of electric batteries slidably received within said tube in end to end relationship with each other, means defining a threaded axial opening in each end of said tube, and electric bulb threadably received in each of said threaded openings, means defining a bolt receiving opening extending diametrically through said tube midway of the length thereof, a bolt adapted to pass through the bolt receiving openings in said tube and said toy to pass through said tube between the adjacent ends of said batteries, a nut adapted to be threadably received on said bolt to detachably clamp said tube against a surface of said toy, the axial length of said tube being such that when said bolt is received in the bolt receiving opening of said tube, the distance between one side of said bolt and the adjacent threaded opening exceeds the length of one of said batteries by a distance such that the bulb received in the threaded opening may be selectively threaded into or out of electric contact with the adjacent end of the battery disposed between said bulb and said bolt to make or break an electric circuit extending from one terminal of said battery through said bulb, the wall of said tube and said bolt to the opposite terminal of said battery.

* * * * *

UNITED STATES PATENT AND TRADEMARK OFFICE

CERTIFICATE OF CORRECTION

PATENT NO. : 4,255,895

DATED : March 17, 1981

INVENTOR(S) : John F. LaBrecque

It is certified that error appears in the above—identified patent and that said Letters Patent is hereby corrected as shown below:

Column 2, line 29, "illustrating" should read --illuminating--

Signed and Sealed this

Sixth Day of April 1982

[SEAL]

*Attest:*

GERALD J. MOSSINGHOFF

*Attesting Officer*

*Commissioner of Patents and Trademarks*